US009936816B2

(12) United States Patent
Lowe

(10) Patent No.: US 9,936,816 B2
(45) Date of Patent: Apr. 10, 2018

(54) FIRE RESISTANT MATTRESSES, FIRE RESISTANT MATTRESS COVER MATERIALS AND RELATED METHODS

(71) Applicant: Trafalgar Associates, LLC, Vonore, TN (US)

(72) Inventor: Vernon J. Lowe, Greenback, TN (US)

(73) Assignee: Trafalgar Associates, LLC, Vonore, TN (US)

( * ) Notice: Subject to any disclaimer, the term of this patent is extended or adjusted under 35 U.S.C. 154(b) by 0 days.

(21) Appl. No.: 15/019,330

(22) Filed: Feb. 9, 2016

(65) Prior Publication Data

US 2016/0235215 A1 Aug. 18, 2016

Related U.S. Application Data

(60) Provisional application No. 62/113,795, filed on Feb. 9, 2015, provisional application No. 62/181,036, filed on Jun. 17, 2015.

(51) Int. Cl.
*A47C 27/00* (2006.01)
*A47C 21/04* (2006.01)
(Continued)

(52) U.S. Cl.
CPC ..... *A47C 31/001* (2013.01); *A47C 21/044* (2013.01); *A47C 27/002* (2013.01);
(Continued)

(58) Field of Classification Search
CPC ... A47C 21/044; A47C 27/002; A47C 27/005; A47C 27/006; A47C 27/007;
(Continued)

(56) References Cited

U.S. PATENT DOCUMENTS 4,921,756 A * 5/1990 Tolbert ..... D02G 3/185 428/373
5,091,243 A 2/1992 Tolbert et al.
(Continued)

FOREIGN PATENT DOCUMENTS

EP 0 391 000 A2 10/1990

OTHER PUBLICATIONS

Heathcoat Fabrics. "3D Spacer Fabrics.CEtec" website brochure. http:/www.heathcoat.co.uk/Amarkets/3d-controlled-expansion, copyright 2014, downloaded Jan. 15, 2015.
(Continued)

*Primary Examiner* — Ifeolu Adeboyejo
(74) *Attorney, Agent, or Firm* — J. Bennett Mullinax, LLC

(57) ABSTRACT

Fire resistant mattresses, fire resistant mattress cover materials and related methods are provided. The fire resistant mattress cover material for use as an outer layer on a mattress can include a three-dimensional knit fabric. In some embodiments, the three-dimensional knit fabric can include a first layer comprising fire resistant corespun yarns, which can be glass reinforced continuous multifilament micro denier yarns, that form a fire resistant barrier when exposed to at least one of heat or flame and a second layer comprising polymer filament yarns. The three-dimensional knit fabric can also include a middle layer between the first layer and the second layer. The middle layer can include monofilament polymer yarns knitted to provide structural support and space between the first layer and the second layer.

15 Claims, 8 Drawing Sheets

(51) Int. Cl.
*A47C 31/00* (2006.01)
*D04B 1/14* (2006.01)

(52) U.S. Cl.
CPC ..... *A47C 31/006* (2013.01); *A47C 31/007* (2013.01); *D04B 1/14* (2013.01); *D10B 2401/04* (2013.01); *D10B 2503/00* (2013.01)

(58) Field of Classification Search
CPC ... A47C 27/008; A47C 31/001; A47C 31/006; A47C 31/007
See application file for complete search history.

(56) References Cited

U.S. PATENT DOCUMENTS 5,540,980 A * 7/1996 Tolbert ..... D02G 3/185 428/215
5,694,981 A * 12/1997 Stanhope ..... A41D 31/0022 139/383 R
5,870,785 A * 2/1999 Hoorens ..... A47C 31/006 442/304
6,146,759 A * 11/2000 Land ..... D02G 3/182 428/370
6,287,690 B1 9/2001 Land
6,410,140 B1 * 6/2002 Land ..... D02G 3/185 428/370
6,553,749 B2 4/2003 Land et al.
6,606,846 B2 8/2003 Land
7,601,414 B2 10/2009 Handermann et al.
8,118,920 B2 * 2/2012 Vrzalik ..... A47C 21/044 5/652.1
8,955,337 B2 * 2/2015 Parish ..... A47C 21/044 62/285
9,433,300 B2 * 9/2016 Gibson ..... A47C 21/044
2006/0075567 A1 * 4/2006 DeFranks ..... A47C 27/005 5/699
2006/0080778 A1 * 4/2006 Chambers ..... A47C 21/044 5/652.2
2006/0135014 A1 * 6/2006 Murphy ..... A47C 31/001 442/304
2006/0185343 A1 * 8/2006 Coombs ..... D02G 3/38 57/210
2006/0228528 A1 10/2006 Link et al.
2006/0236462 A1 10/2006 Boyd
2007/0249251 A1 * 10/2007 Sytz ..... A47C 31/001 442/312
2009/0149101 A1 * 6/2009 Sytz ..... A47C 31/001 442/318
2010/0261398 A1 10/2010 Dry et al.
2011/0016635 A1 * 1/2011 Svensrud ..... A47C 27/14 5/724
2011/0173757 A1 * 7/2011 Rensink ..... A47C 27/04 5/698
2011/0283459 A1 * 11/2011 Essers ..... A47C 27/005 5/699
2012/0255128 A1 * 10/2012 Sytz ..... A47C 27/008 5/698
2012/0258643 A1 * 10/2012 Ruf ..... A47C 31/001 442/414
2013/0344278 A1 * 12/2013 Horst ..... A47C 27/002 428/74
2014/0075678 A1 3/2014 Murphy et al.
2016/0157631 A1 * 6/2016 Milnes ..... A47C 27/002 5/691

OTHER PUBLICATIONS

Heathcoat Fabrics, "3D Spacer Fabrics:spacetec" website brochure, http:/www.heathcoat.co.uk/Amarkets/3d-spacer-fabrics. copyright 2014, downloaded Jan. 15, 2015.
Alessandra Yarns, "Bedding Products with Alessandra Yarns: The Softer Side of Flame-Resistant Performance" borchure, copyright 2009.
Alessandra Yarns. "InnovativeTextile Solutions for Luxury Comfort and Flame-Resistant Protection" website page, http:/www.alessandrayarns.com/about.html, downloaded Jan. 26, 2015.
Alessandra Yarns, "Alessandra Yarns: Engineered for High-Performance Fabrics"borchure, copyright 2009.
"Bedding Products with Alessandra Yarns: The Softer Side of Flame-Resistant Performance" website page, http:/www.alessandrayarns.com/applications.html, downloaded Jan. 26, 2015.
Alessandra Yarns, "Protective Yarns. Engineered Solutions" website page, http:/www.alessandrayarns.com/default.html, downloaded Jan. 26, 2015.
Material Safety Data Sheet for Alessandra Flame Resistant Fabric, original Publication date Apr. 12, 2003 and revision date Jun. 13, 2008.
European Search Report for European Application No. 15172614.8-1653 dated Dec. 11, 2015.

* cited by examiner

FIRE RESISTANT MATTRESSES, FIRE RESISTANT MATTRESS COVER MATERIALS AND RELATED METHODS

RELATED APPLICATION

The presently disclosed subject matter claims the benefit of U.S. Provisional Patent Application Ser. No 62/113,795, filed Feb. 9, 2015, the disclosure of which is incorporated herein by reference in its entirety, and the benefit of U.S. Provisional Patent Application Ser. No. 62/181,036, filed Jun. 17, 2015, the disclosure of which is incorporated herein by reference in its entirety. The presently disclosed subject matter further claims the benefit of European Patent Application No. EP15172614.8, filed Jun. 18, 2015, the disclosure of which is also incorporated herein by reference in its entirety.

TECHNICAL FIELD

The present subject matter relates to fire resistant mattresses, fire resistant mattress cover materials and related methods. In particular, the present subject matter relates to fire resistant mattresses and fire resistant mattress cover materials that can meet current flammability standards while providing enhance comfort during use.

BACKGROUND

The Federal Flammability Act 16 C.F.R. Part 1632 was originally established to provide a federal flammability standard for bedding mattresses to reduce the chance and size of accidental fires caused by a cigarette or some form of smoldering heat source coming into contact with the bedding mattresses. The Consumer Product Safety Commission ("CPSC") recognized this flammability standard was inadequate due a significant number of mattress fires that were the result of some form of open fuel source.

Working with the National Institute for Safety and Technology ("NIST") in October 2001, the CPSC issued an advance notice of proposed rulemaking ("ANPR") concerning the open flame ignition of mattresses/bedding to broaden the standard to include some form of open fuel source requirement. These flammability standards were researched and in 2005 the CPSC issued a notice of proposed rulemaking ("NPR") proposing a flammability standard based on the NIST research.

The characteristics of mattress/bedding fires and research conducted to develop the standard are discussed in detail in the NPR, 70 F.R. 2470, incorporated herein by reference in its entirety. The final rule was enacted in March of 2006 as 16 C.F.R. Part 1633 entitled Standard for the Flammability (Open Flame) of Mattress Sets (hereinafter the "1633 flammability standard") as published in the Federal Register/Vol. 71, No. 50. Mar. 15, 2006/Rules and Regulations, incorporated herein by reference in its entirety. The 1633 flammability standard applies to mattresses and mattress and foundation sets ("mattress sets") "Mattress" is defined as a resilient material, used alone or in combination with other materials, enclosed in a ticking and intended or promoted for sleeping upon.

Because a mattress contains a substantial amount of flammable materials, if a mattress that does not meet the 1633 flammability standard ignites in a bedroom fire, the mattress will burn rapidly, and will quickly reach dangerous flashover conditions within a few minutes. Flashover is the point at which the entire contents of a room are ignited simultaneously by radiant heat, making conditions in the room untenable and safe exit from the room impossible. At flashover, room temperatures typically exceed 600-800° C. (approximately 1100-1470' F.). About two-thirds of all mattress fatalities pre-1633 flammability standard were attributed to mattress fires that lead to flashover. This accounted for nearly all of the fatalities that occurred outside the room where the fire originated and about half of the fatalities that occurred within the room of origin.

The size of a fire can be measured by its rate of heat release. A heat release rate of approximately 1,000 kilowatts ("kW") leads to flashover in a typical room. Tests of twin size mattresses of traditional constructions (complying with the earlier mattress cigarette ignition standard in 16 C F.R. 1632) without bedclothes have measured peak heat release rates that exceeded 2,000 kW in less than 5 minutes. In tests of traditional king size mattresses, peak rates of heat release were nearly double that amount.

The goal of the 1633 flammability standard was to minimize or delay flashover when a mattress was ignited in a typical bedroom fire. With certain exceptions explained below, the standard requires manufacturers to test specimens of each of their mattress prototypes (designs) before mattresses based on that prototype may be introduced into commerce. The 1633 flammability standard prescribes a full-scale test using a pair of T-shaped gas burners designed to represent burning bedclothes. The mattress set must not exceed a peak heat release rate of 200 kW at any time during a 30 minute test and the total heat release for the first 10 minutes of the test must not exceed 15 mega joules ("MJ"). Mattresses that meet the 1633 flammability standard's criteria will make only a limited contribution to a fire, especially in the early stages of the fire. This will allow occupants more time to discover the fire and escape. As used in the 1633 flammability standard, the term "mattress set" means a mattress alone if the mattress is manufactured for sale without a foundation, or a mattress and a foundation together, if the mattress is manufactured for sale with a foundation. Under the 1633 flammability standard, a mattress manufactured for sale with a foundation must be tested with its foundation and a mattress manufactured for sale alone must be tested alone.

According to the International Sleep Products Association ("ISPA"), the top four producers of mattresses and foundations account for almost 60 percent of total U.S. production. In 2003, there were 571 establishments producing mattresses in the U.S. The volume of affected product has remained stable as a result of the downturn in the U.S. economy since 2008 and is currently estimated at 13,000,000 mattresses and 7,000,00 interior spring bases.

Mattresses and foundations are typically sold as sets. However, more mattresses are sold annually than foundations. Some mattresses are sold as replacements for existing mattresses (without a new foundation) or are for use in platform beds or other beds that do not require a foundation. ISPA estimated that the total number of U.S. conventional mattress shipments was 22.5 million in 2004, and would be 23.0 million in 2005. These estimates do not include futons, crib mattresses, juvenile mattresses sleep sofa inserts, or hybrid water mattresses. These "non-conventional" sleep surfaces are estimated to comprise about 10 percent of total annual shipments of all sleep products. The value of conventional mattress and foundation shipments in 2004, according to ISPA, was $4.10 and $1.69 billion respectively, compared to $3.28 and $1.51 billion respectively in 2002. These 2013 annualized volumes were estimated at 20,000,000 with values having not increased significantly due to the US recession. Even these tower numbers are still considered by Industry experts to be in the $1.5 billion range despite the reduction in volume.

The expected useful life of mattresses can vary substantially, with more expensive models generally experiencing the longest useful lives. Industry sources recommend replacement of mattresses after 10 to 12 years.

It has been estimated that about 15,000 mattress related fires occur per year. For example, annual estimates of national fires and fire losses involving ignition of a mattress or bedding are based on data from the U.S. Fire Administration's National Fire Incident Reporting System ("NFIRS") and the National Fire Protection Administration's ("NFPA") annual survey of fire departments. The most recent national fire loss estimates indicated that mattresses and bedding were the first items to ignite in 15,300 residential fires attended by the fire service annually during 1999-2002. These fires resulted in 350 deaths, 1,750 injuries and $295.0 million in property loss annually. Of these, the commission considers an estimated 14,300 fires, 330 deaths, 1,680 injuries, and $281.5 million in property loss annually to be addressable by the standard. The term 'addressable' means the incidents were of a type that would be affected by the standard solely based on the characteristics of the fire cause (i.e., a fire that ignited a mattress or that ignited bedclothes which in turn ignited the mattress).

Among the addressable casualties, open flame fires accounted for about 110 deaths (33 percent) and 890 injuries (53 percent) annually. Smoking fires accounted for 180 deaths (55 percent) and about 520 injuries (31 percent) annually. Children younger than age 15 accounted for an estimated 90 addressable deaths (27 percent) and 340 addressable injuries (20 percent) annually. Adults age 65 and older accounted for an estimated 80 addressable deaths (24 percent) and 180 addressable injuries (11 percent) annually.

The standard sets forth performance requirements that ail mattress sets must meet before being introduced into commerce. The test method is a full scale test based on the NIST research discussed above and in the NPR. The mattress specimen (a mattress alone or mattress and foundation set usually m a twin size) is exposed to a pair of T-shaped propane burners and allowed to burn freely for a period of 30 minutes. The burners were designed to represent burning bedclothes. Measurements are taken of the heat release rate from the specimen and energy generated from the fire. The standard establishes two test criteria, both of which the mattress set must meet in order to comply with the standard:

(1) The peak rate of heat release for the mattress set must not exceed 200 kW at any time during the 30 minute test; and (2) The total heat release must not exceed 15 MJ for the first 10 minutes of the test.

Traditionally, woven ticking fabrics are used to cover the mattresses and form the outer surface of the mattresses. To meet these performance requirements, a fire-resistant barrier material is laminated to the inner surface ("burn surface") of the woven ticking fabric. Alternatively, a fire-resistant 'sock' or sleeve component comprising a two-dimensional stretchable knit is placed over the mattress core during assembly and a woven licking fabric placed over the knitted fire-resistant sock. These woven ticking fabrics generally require a large amount of batting secured thereto to provide a level of comfort to the user during use, but generally do little to enhance such comfort. For example, these woven ticking fabrics, whether with a laminated backing or used over the knitted sock, do not disperse heat very well. As the user becomes hot and sweats, the woven ticking fabric does not wick the moisture that passes through the sheets away from the user which can lead to an uncomfortable resting period for the user. Further, these woven ticking fabrics provide limited, if any, load barrier comfort support that is recoverable from compression.

As such a need exists for fire resistant mattresses and fire resistant mattress cover materials that can form the outer surface of the respective mattresses that meet current flammability standards and that can provide an integral 'airflow' system, moisture transfer, wicking capabilities load distribution, and/or compression recovery as integral features of the mattress cover material.

SUMMARY

The present subject matter provides fire resistant mattresses, fire resistant mattress cover materials and related methods. In particular, the present subject matter relates to fire resistant mattresses and fire resistant mattress cover materials that can meet current flammability standards while providing enhance comfort during use. Methods related to the manufacture and use of the mattresses and cover materials disclosed herein are also provided.

Thus, it is an object of the presently disclosed subject matter to provide fire resistant mattresses and fire resistant mattress cover materials as well as methods related thereto. While one or more objects of the presently disclosed subject matter having been stated hereinabove, and which is achieved in whole or in part by the presently disclosed subject matter, other objects will become evident as the description proceeds when taken in connection with the accompanying drawings as best described hereinbelow.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which:

FIG. 8 show a graph of results of peak rate of heat release versus time and a graph of the results of total heat release versus time based on test results of an example embodiment of a mattress comprising a cover material according to the subject disclosed herein based on testing outlined in the 1633 flammability standard.

Figure 1:
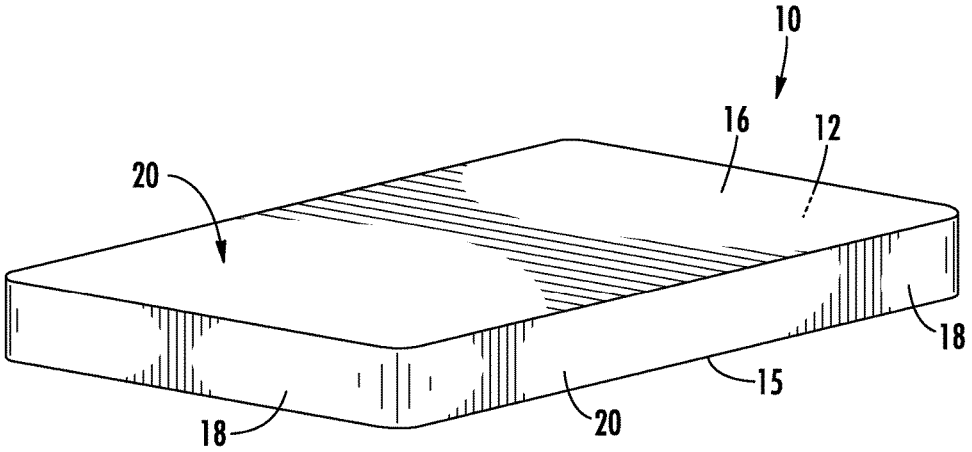
FIG. 1 illustrates a perspective view of an embodiment of a mattress that includes an embodiment of the cover material according to the present subject matter.

Repeat use of reference characters in the present specification and drawings is intended to represent the same or analogous features or elements of the present subject matter.

DETAILED DESCRIPTION

Reference now will be made to the embodiments of the present subject matter, one or more examples of which are set forth below. Each example is provided by way of an explanation of the present subject matter not as a limitation. In fact, it will be apparent to those skilled in the art that various modifications and variations can be made in the present subject matter without departing from the scope or spirit of the present subject matter. For instance, features illustrated or described as one embodiment can be used on another embodiment to yield still a further embodiment. Thus, it is intended that the present subject matter cover such modifications and variations as come within the scope of the appended claims and their equivalents. It is to be understood by one of ordinary skill in the art that the present discussion is a description of exemplary embodiments only, and is not intended as limiting the broader aspects of the present subject matter, which broader aspects are embodied in exemplary constructions.

Although the terms first, second, right, left, front, back, etc. may be used herein to describe various features, elements, components, regions, layers and/or sections, these features, elements, components, regions, layers and/or sections should not be limited by these terms. These terms are only used to distinguish one feature, element, component, region, layer or section from another feature, element, component, region, layer or section. Thus, a first feature, element, component, region, layer or sections, discussed below could be termed a second feature, element, component, region, layer or section without departing from the teachings of the disclosure herein.

Similarly, when a layer or coating is being described in the present disclosure as "on" or "over" another layer or substrate, it is to be understood that the layers can either be directly contacting each other or have another layer or feature between the layers, unless expressly stated to the contrary. Thus, these terms are simply describing the relative position of the layers to each other and do not necessarily mean "on top of" since the relative position above or below depends upon the orientation of the device to the viewer.

Embodiments of the subject matter of the disclosure are described herein with reference to schematic illustrations of embodiments that may be idealized. As such, variations from the shapes and/or positions of features, elements or components within the illustrations as a result of, for example but not limited to, user preferences, manufacturing techniques and/or tolerances are expected. Shapes, sizes and/or positions of features, elements or components illustrated in the figures may also be magnified, minimized, exaggerated, shitted or simplified to facilitate explanation of the subject matter disclosed herein. Thus, the features, elements or components illustrated in the figures are schematic in nature and their shapes and/or positions are not intended to illustrate the precise configuration of the subject matter and are not intended to limit the scope of the subject matter disclosed herein.

It is to be understood that the ranges and limits mentioned herein include all ranges located within the prescribed limits (i.e., subranges). For instance, a range from about 100 to about 200 also includes ranges from 110 to 150, 170 to 190, 153 to 162, and 145.3 to 149.6. Further, a limit of up to about 7 also includes a limit of up to about 5, up to 3, and up to about 4.5, as well as ranges within the limit, such as from about 1 to about 5, and from about 3.2 to about 6.5.

As used herein, the term "polymer" generally includes, but is not limited to, homopolymers, copolymers, such as, for example, block, graft, random and alternating copolymers, and terpolymers; and blends and modifications thereof.

The present subject matter comprises fire resistant mattress, fire resistant cover material used to provide an outer surface of a mattress and related methods. In particular, cover material can comprise a spacer fabric that comprises a three-dimensional knit fabric. The cover material that comprises a three-dimensional knit fabric consolidates the fire-resistant feature of the 1633 flammability standard with the comfort aspects of a ticking fabric by providing a single non-laminated fabric. This single non-laminated fabric has an inner, or first, layer that forms a fire-resistant interior wall, an outer, or second, layer that in combination with a supportive middle layer between the inner layer and the outer layer, provides comfort aspects such as compressive support, moisture wicking, and air circulation features not recognized by traditional two-dimensional woven ticking fabrics. Thereby, the cover material that comprises the three-dimensional knit fabric eliminates the need for an uncomfortable laminated woven ticking fabric or dual layers of fabric with an outer woven ticking fabric and an inner fire resistant two-dimensional knit fabric having polyester batting therebetween to try to provide comfort cushioning to the ticking fabric.

The consolidated single fabric design reduces weight as well as manufacturing and assembly costs, while at the same time improving the temperature regulating and moisture wicking capabilities for increased comfort for the mattress user, in particular, the middle layer provides an air-gap between the inner layer and the outer layer that allows for improved air circulation and moisture wicking capabilities around a body of a user lying on the mattress. The cover material that comprises the three-dimensional knit fabric can thus provide air circulation that can influence, adjust, and ultimately control the mattress top surface temperature.

For example, as shown in FIG. 1, a fire resistant mattress 10 can be provided that includes a body 12 having a size and shape to support a user when lying down upon and resting on the mattress 10. The mattress 10 can also comprise a cover material 20 that can be secured around the body 12 to form an outer surface 14 of the mattress. For example, the cover material can operate in a manner similar to a tradition ticking fabric. However, the cover material comprises three-dimensional knit fabric instead of a tightly woven fabric. For example, the cover material can comprise a spacer fabric that is a three-dimensional knit fabric. In particular, the structure of the cover material 20 can comprise a three-dimensional knitted textile material that provides an integral 'airflow' system, moisture transfer, wicking capabilities, and/or compression recovery as integral features of the mattress cover material. In some embodiments, the cover material 20 of the three-dimensional knit fabric can cover the top 16 and the bottom 15 (not seen) of the body 12 of the mattress 10 while a different fabric can cover the sides 18 of the body of the mattress 10 so that the cover material 20 forms the outer surface 14 of the mattress 10 on which the user will lie. In some embodiment as shown in FIG. 1 the cover material 20 of three-dimensional knit fabric can cover the top 16, the sides 18, and the bottom 15 of the body 12 of the mattress 10.

Figure 2:
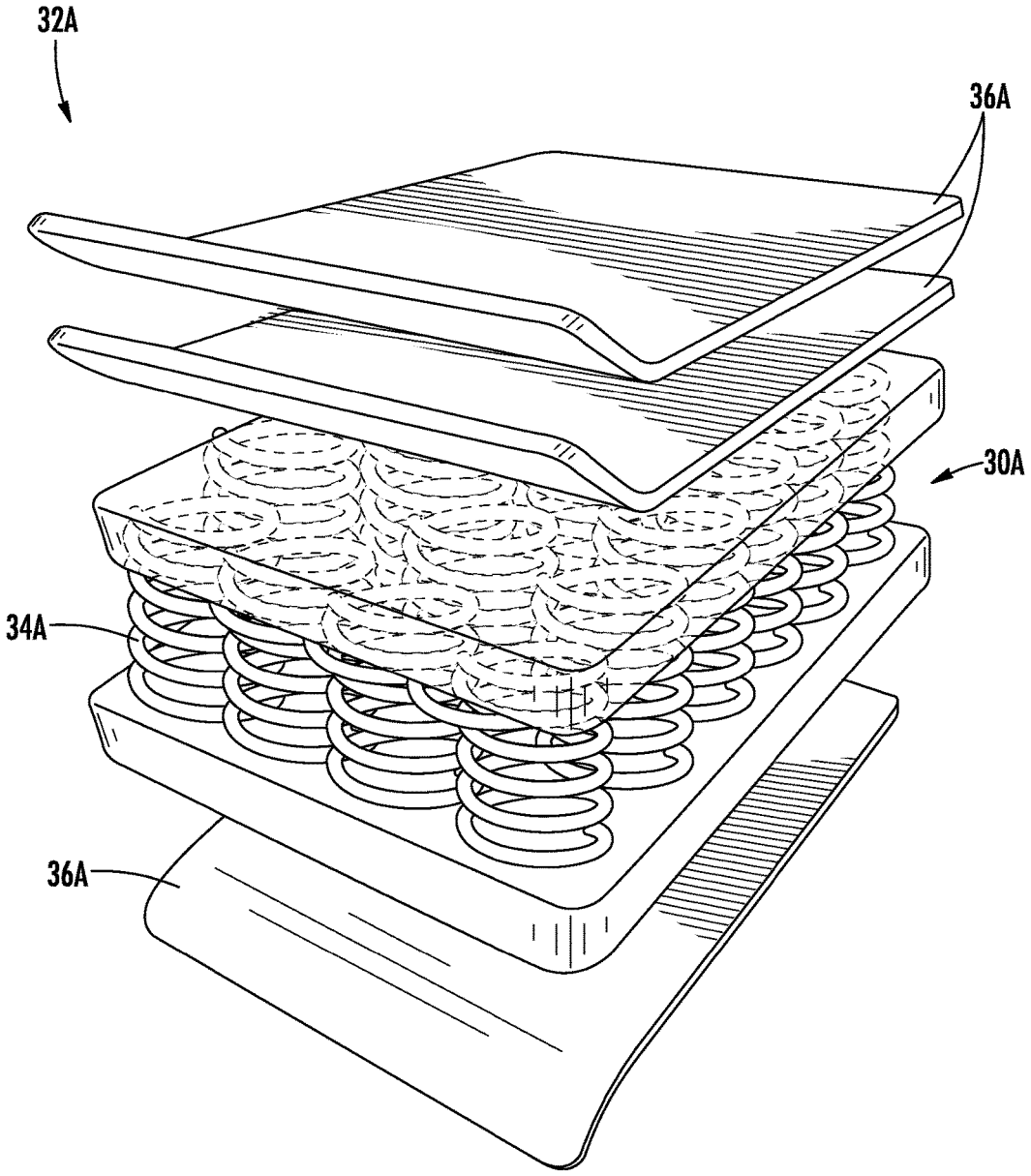
FIG. 2 illustrates an exploded perspective view of an embodiment of a mattress that comprises a cover material according to the present subject matter.
Figure 3:
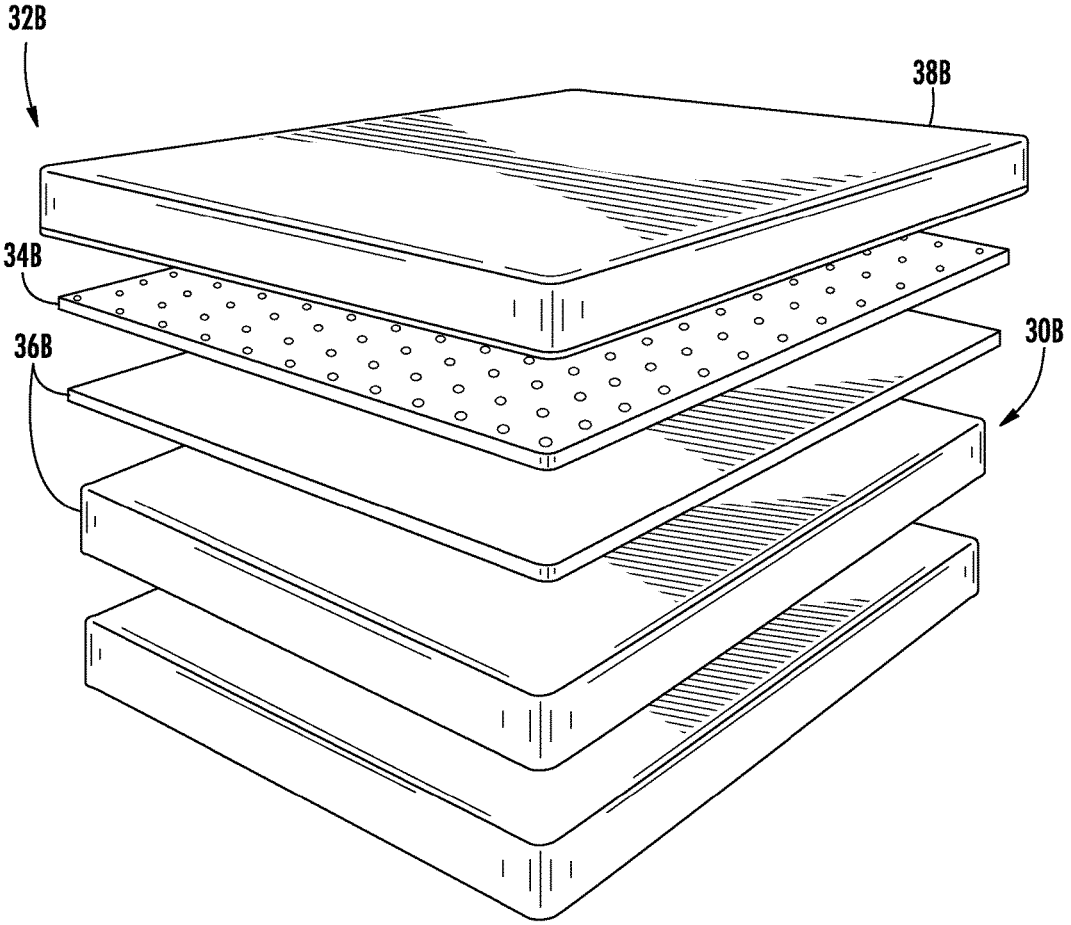
FIG. 3 illustrates an exploded perspective view of another embodiment of a mattress that comprises a cover material according to the present subject matter.

The cover material 20 can be used on generally any kind of mattress, such as those manufactured and/or distributed by companies such as SERTA, SIMMONS, SEALY, TEMPURPEDIC, and SELECT COMFORT, for example. Thus, the body 12 of the mattress 10 can comprise a variety of materials. For example, FIGS. 2 and 3 show exploded views of example embodiments of two common types of mattress bodies that can have an outer surface formed by the cover material 20. In FIG. 2, an exploded view is provided of a body 32A of an innerspring mattress 30A that comprises precisely configured tempered steel coil springs 34A and several different qualities of foam padding 36A, which work together to reduce stress to pressure points such as shoulders and hips, support the users weight, and comfortably suspend the body of the user throughout the night. FIG. 3 illustrates a body 32B of a foam mattress WB that comprises a convoluted center foam 34B surrounded by other foams and batting, such as super soft foam MB and a thermally bonded batting 38B. The foam within foam mattress 30B also work together to reduce stress to pressure points such as shoulders and hips, support the user's weight, and comfortably suspend the body of the user throughout the night.

Figure 4:
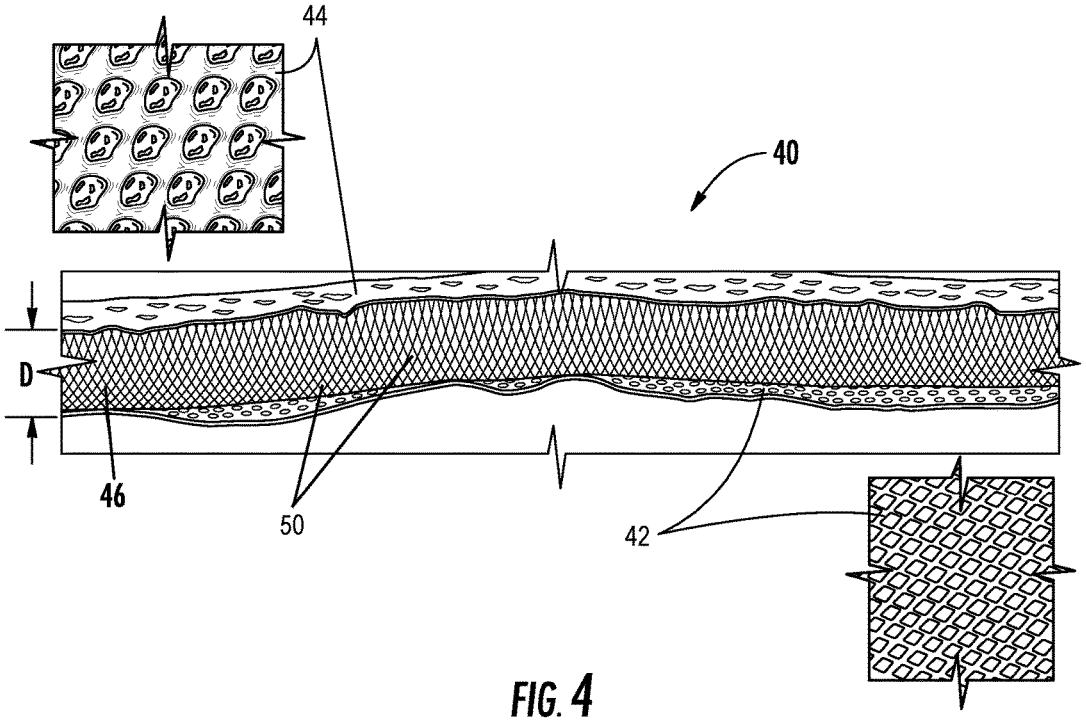
FIGS. 4 and 5 illustrate side perspective views of embodiments of a cover material according to the present subject matter.
Figure 5:
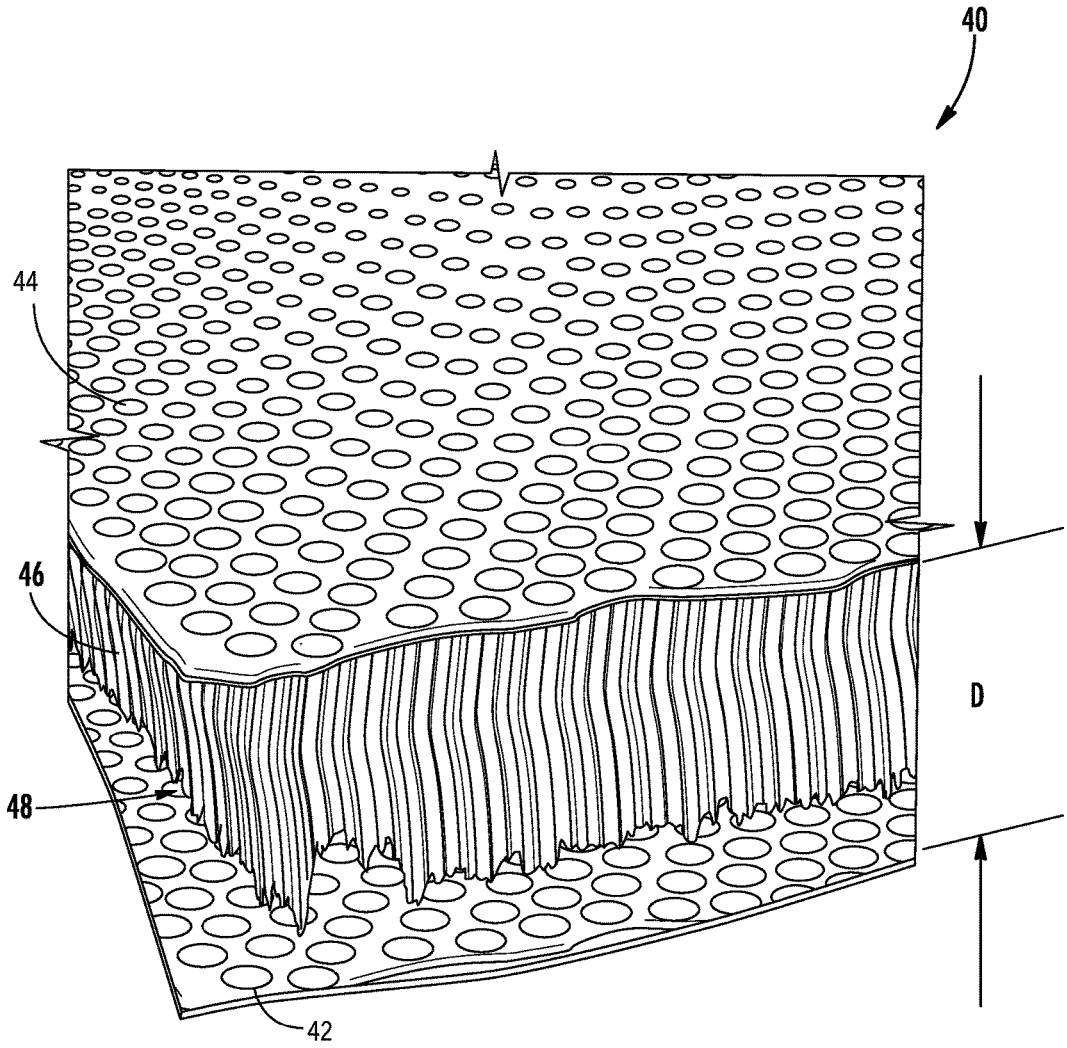

The three-dimensional knit fabric of the cover material 20 can be a warp knit, such as a double needle bed raschel type spacer knit. For example, FIGS. 4 and 5 illustrate an embodiment of a three-dimensional knit fabric 40 that can comprise a first layer 42 comprising fire resistant corespun yarns, a second layer 44 comprising polymer filament yarns, and a middle layer 48 between the first layer and the second layer. The middle layer 48 can comprise monofilament polymer yarns knitted to provide structural support and space between the first layer 42 and the second layer 44. The middle layer 46 can create a separation distance between the first layer 42 and the second layer 44 of the three-dimensional knit fabric 40. The monofilament polymer yarns of the middle layer 46 can form one or more channels 50 within the structure to provide the airflow, compression and load spreading features of the cover material 20. For example, the monofilament polymer yarns of the middle layer 46 can form a separation distance P between the first layer 42 and a second layer 44 to form channels 50 therebetween. In some embodiments, the separation distance D is between about 2 mm and about 10 mm. In some embodiments, the separation distance D can be such the overall thickness of the cover material 20 can be between about 2 mm and about 10 mm. For examples, the separation distance D is chosen based on at least one of the support features of the cover material 20 or the airflow features of the cover material 20.

For example, the cover material can comprise a three-dimensional knit fabric that forms a first layer comprising glass reinforced continuous multifilament micro denier yarns that form a fire resistant barrier when exposed to at least one of heat or flame and a second layer comprising polymer filament yarns. Between the first layer and the second layer resides a connecting middle layer that can comprise monofilament polymer yarns knitted to provide structural support and space between the first layer and the second layer.

In some embodiments, the first layer can substantially comprise the fire resistant corespun yarn. The corespun yarn can, for example, comprises a core of high temperature resistant continuous inorganic filaments surrounded by a first sheath of fibers. Further, a second sheath of fibers can surround the first sheath and the core to form a double sheathed corespun yarn. In some embodiments, the corespun yarns can have a weight per unit length of about 20.5 to about 250 denier.

For example, in some embodiments, the corespun yarn can comprise a core of high temperature resistant continuous inorganic filaments, a first sheath of staple fibers surrounding the core, wherein the staple fibers comprise fibers of at least one fire resistant material and a second sheath of staple fibers surrounding the first corespun yarn. In some embodiments, a blend of two different fire resistant fibers are provided in the first sheath, one which is effective to char and remain dimensionally stable when exposed to open flame, and a second which releases oxygen depleting gases to extinguish the burning non-flame-resistant fiber in the second sheath.

The continuous inorganic filaments can comprise fiberglasses, carbons, ceramics, quartzes, steels, and combinations thereof. The core can have a structure which includes low temperature resistant synthetic continuous filaments such as nylons, polyesters and polyolefins like polyethylene and polypropylene. In some embodiments, the continuous iorganic filaments can comprise two-plied filaments with the inorganic filament core. The two plied filament yarns can comprise combinations of filaments of nylons, polyesters, and polyolefins.

For example, the first sheath can comprise staple fibers surrounding the core. The staple fibers can comprise fibers of at least one of meta-aramids, para-ararmids, fluoropolymers and copolymers, chloropolymers and copolymers, polybenzimidazole, polyimides, polyamldeimides, partially oxidized polyacrylonitriles, novoloids, poly (p-phenylene benzobisoxazoles), poly (p-phenylene benzothiazoles), polyphenylene sulfides, flame retardant viscose rayons, polyvinyl chloride homopolymers and copolymer, polyetheretherketones, polyketones, polyetherimides, polylactides, and combinations thereof.

The second sheath can comprise a variety of different types of either natural (e.g., vegetable, mineral or animal) or synthetic fibers. For example, in some embodiments, the second sheath can comprise fibers such as cottons, wools, nylons, polyesters, polyolefins, rayons, acrylics, silks, mohair, cellulose acetate, polylactides, or blends of such fibers. For instance, in some embodiments, the fibers used in the yarns of second sheath can comprise low to medium temperature resistant staple fibers such as rayons, polyesters, cottons or polyolefins.

For example, in sense embodiments, the corespun yarn can be a continuous multifilament micro denier yarn that composes a polyester fiber filament core and modacrylic copolymer fiber filament inner sheath and a fire resistant rayon filament wrap outer sheath. In such embodiments, the polyester fiber filament of the continuous multifilament micro denier yarn can provide tensile strength. The first layer can comprise a closed knit construction to provide a fire resistant barrier that can limit or preclude exposure of combustible material integrated info a mattress-core.

In the three-dimensional knit fabric, the second layer can substantially comprise polymer filament yarn that can comprise polyesters, polypropylenes, polyethylenes, other polyolefins, nylons meta-aramids, para-guards, or the like. For example, the polymer filament yarns can comprise at least one of a polyester filament yarn or a polypropylene yarn. The second layer can comprise a specially designed knitting pattern. For example, the second layer comprises a customer specific knitting pattern. In some embodiments, the second layer comprises a standard mesh knitting pattern that provides at least one of winking or airflow features.

In some embodiments, the second layer can have a chemical coating or can be treated with a chemical finish. The chemical finish or coating can comprise at least one of an infra-red reflective, an antimicrobial, an anti-mildew, an antibacterial, a flame retardant, a fire retardant, or a water repellent. In some embodiments, the second layer can be coated or treated with a intumescent material. The type of finish or coating can be dependent upon the specific bedding mattress application.

In some embodiments, the polymers of the filament yarns of the second layer can comprise a chemical treatment therein. The chemical treatment can comprise at least one of an infra-red reflective, an antimicrobial, an anti-mildew, an anti-bacterial, a flame retardant, a fire retardant, or a water repellant. The type of finish or coating can be dependent upon the specific bedding mattress application. For example, the chemical treatment can be mixed with the polymer during formation of the polymer substance or during fiber formation. In some embodiments, the chemical treatment can be applied to the fibers after formation. An example of an anti-bacterial treatment that can be used as an inclusion, coating, or finish is the anti-bacterial and anti-mildew treatment sold under the trade name COOL MAX FX.

The middle layer of the three-dimensional knit fabric can comprise a monofilament polymer yarn. For example, the monofilament polymer yarn can comprise polyesters, polypropylenes, polyethylenes, polyolefins, nylons, meta-aramids, para-aramids, of the like. For example, the monofilament polymer yarns can comprise at least one of a polyester filament yarn or a polypropylene yarn. The size of the monofilament yarns of the middle layer can vary. For example, the denier of the monofilament polymer yarns of the middle layer can be dependent upon at least one of the support features of the cover material or the airflow features of the cover material. For example, the monofilament polymer yarns of the middle layer can comprise a weight per unit length of between about 20 denier and about 400 denier. In some embodiments, the monofilament polymer yarns of the middle layer can comprise a weight per unit length of between about 70 denier and about 120 denser.

Further, the middle layer can create a separation distance between the first layer and the second layer of the three-dimensional knitted fabric. The monofilament polymer yarns of the middle layer can form one or more channels within the structure to provide the airflow, compression and load spreading features of the product. For example, the monofilament polymer yarns of the middle layer form a separation distance between the first layer and a second layer to form channels therebetween. In some embodiments, the separation distance is between about 2 mm and 10 mm. For examples, the separation distance is chosen based on the at least one of the support features of the cover material or the airflow features of the cover material.

The three-dimensional knit fabrics of the cover material as described above satisfy the standard for flammability (open flame) of mattress set for 18 C.F.R. Part 1633. The three-dimensional knit fabric of the cover material can comprise a breathable fabric. In some embodiments, the second layer of the three dimensional knit fabric of the cover material can form a breathable outer surface of the cover material that can contact the users body. For-example, in some embodiments, the second layer and the middle layer of the three-dimensional knit fabric of the cover material are breathable. In some embodiments, the second layer and the middle layer of the three-dimensional knit fabric of the cover material are breathable.

Figure 6:
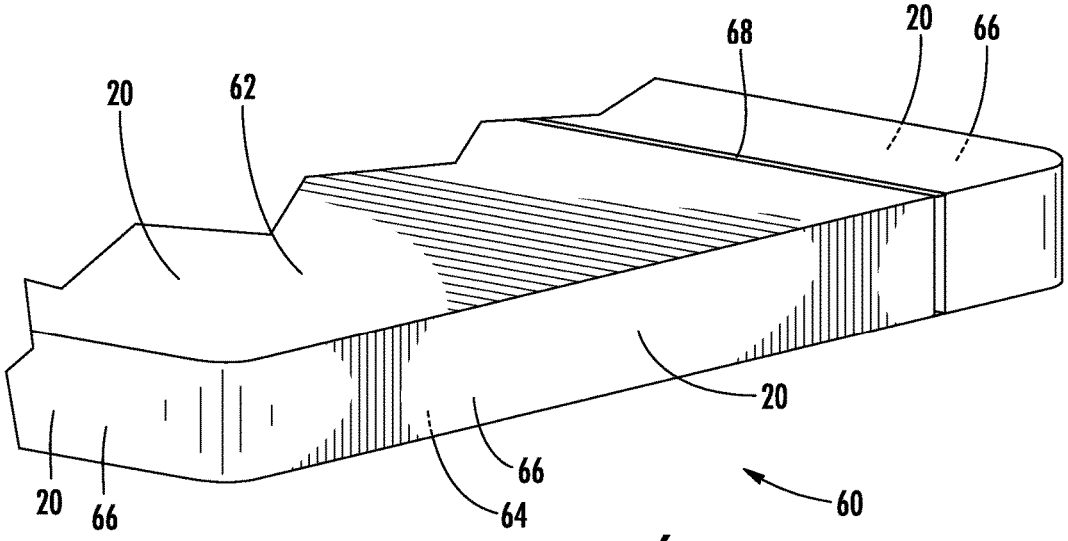

In some embodiments, the cover material can comprise a sleeve that can have a mattress or mattress body inserted therein. Such sleeves can be slid over and around the mattress, in some embodiments, the sleeve can be form: fitted to fit specific sizes of mattresses. For example, as shown in FIG. 6, the cover material 20 can comprise a closable sleeve 60 that is securable around a mattress. In such embodiments, the closable sleeve 60 can be sized to fit specifically sized mattresses. As shown in FIG. 6, the sleeve 80 can comprise a plurality of panels of the cover material 20 of one or more three-dimensional knit fabrics as described above. For example, the sleeve 60 can comprise a top panel 62 and a bottom panel 64 (not seen) as well as side panels 66. In some embodiments, the three-dimensional knit fabric of the cover material 20 that forms the top panel 62 and the bottom panel 64 may have a different construction than the three-dimensional knit fabric of the cover material 20 that forms the side panels 88. In some embodiments, the three-dimensional knit fabric of the cover material 20 that forms the top panel 62, the bottom panel 14 and the side panels 66 can have the same construction.

The sleeve 60 can have a closeable insertion mouth 68 that can permit a mattress to be inserted in the sleeve 60. The closeable insertion mouth 68 can then be closed so that the mattress is fully enveloped. In some embodiments, the insertion mouth 68 for example, may have a zipper secured thereto that can be zipped closed after insertion. In some embodiments, other fastener may be secured to the insertion mouth 68 such as a hook and loop fastener, snap fastener, buttons, or the like, to secure closure of the insertion mouth 68 after insertion of a mattress. Such an insertion mouth 68 can be at any desirable location along the sleeve 60.

As stated above, the cover material can comprise an integral outer surface of the mattress as shown in FIG. 1 that can serve as an outer ticking fabric of a mattress.

In some embodiments, the three-dimensional knit fabric of the cover material can comprise a structure that provides moisture wicking capabilities for health and medical comfort aspects that also meets the 1633 Flammability Standard. The three-dimensional knit fabric of the cover material can have a wide range of thicknesses and contours and can have a structure that can provide compression and load spreading equalization. The three-dimensional knit fabric of the cover material can provide compressibility coupled with support and contouring as an aid for treatment of pressure points and bed sores. In some embodiments, the three-dimensional knit fabric of the cover material can comprise a stretchability and recovery without compromising the fire resistance barrier forming ability of the three-dimensional knit fabric. In some embodiments, the three-dimensional knit fabric can comprise a structure that displays an image such as a logo or wording. The structure of the knit and the yarns used therein can be selected to provide different levels of compression and recovery to satisfy a users desires or requirements. For example, a virtually unlimited range of aesthetic and/or key geometric performance requirements can be obtained with the three-dimensions knit fabric. This could include but not limited to contoured and compression molded/heat formed features to satisfy anatomical requirements, therapeutic corsets and correction devices. Further, the mattresses and cover materials disclosed herein can comprise the ability to provide an air circulation regularization substrate for specific body and medical application requirements. In some embodiments, a whole range of custom application specific products can be provided with a cooling/warming, fragrance and sensorial applications.

Based on the structure of the knit and the yarns used, the cover material can be washable and can be quick drying. The cover material can be lightweight and portable. The three-dimensional knit fabric can comprise at least one of an infra-red reflective, antimicrobial, anti-mildew, anti-bacterial, a fire resistant, or moisture repellent coating. In some embodiments, the three-dimensional knit fabric can be coated or treated with a intumescent material. The three-dimensional knit fabric can comprise an air circulation regularization substrate for specific body and medical application requirements. The three-dimensional knit cover material disclosed herein is relatively small and unobtrusive in nature when compared to foam and memory application competitors.

Figure 7A:
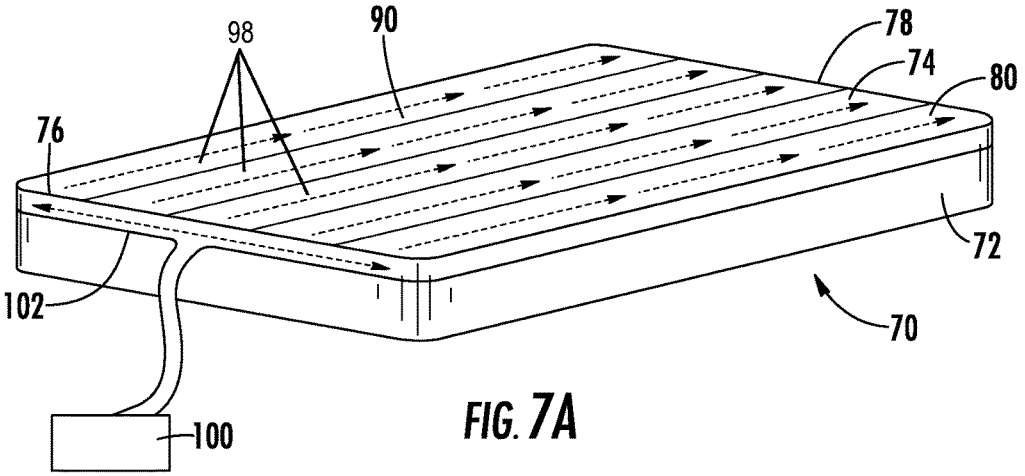
FIG. 7A illustrates a schematic perspective view of an embodiment of a mattress that comprises a cover material that can include an air flow feature according to the present subject matter.
Figure 7B:
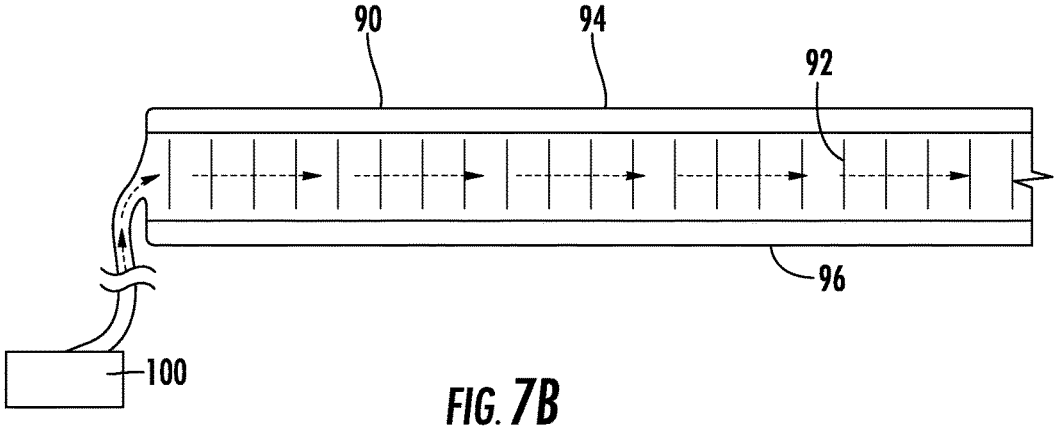
FIG. 7B illustrates a schematic cross-sectional view of a portion of an embodiment of a cover material that can include an air flow feature according to the present subject matter.

In some embodiments, as stated above, the cover material can comprise a middle layer that forms one or more channels within the structure to provide the airflow, compression and load spreading features with the monofilament polymer yarns of the middle layer forming a separation distance between the first layer and a second layer to form the channels therebetween. As shown in FIG. 7A, a mattress 70 can have a body 72 and a cover material 80 of a three-dimensional knit fabric 90 comprising a structure that can allow airflow therethrough. The cover material 80 can cover the body 72. The cover material 80 can form a top panel 82 that forms a top surface 74 of the mattress 70. The top panel 82 of the cover material 80 can have an air pump 100 secured thereto that provides an airflow between outer layers of the three-dimensional knit fabric 90. For example, as shown in FIG. 7B, the cover material 80 can have an air pump 100 secured thereto that provides an airflow through a middle layer 92 of the three-dimensional knitted fabric 90 between a first layer 94 and a second layer 96. For example, the middle layer 92 of the three-dimensional knitted fabric 90 can form one or more channels 98 through which the air can flow.

The first layer 94 and the second layer 96 of the knitted fabric 90 can have a closed construction (see FIG. 7B) that can facilitate the flow of air across the length L and/or width W of the mattress 70 (see FIG. 7A) on which the cover material 80 resides. For example, in some embodiments, as shown in FIG. 7A, the air pump 100 can provide air flow through a manifold 102 that can extend across a base of a bottom portion (or top portion) of the cover material 80 of the top panel 82 so that air flows from the base 76 of the mattress 70 to the head 78 of the mattress 70. In some embodiments (not shown in FIG. 7A), an air pump 100 can be secured to a side portion of the cover material 80 to create an airflow across the width of the mattress 70. In some embodiments (not shown), a sheet placed over the mattress 70 and cover material 80 can facilitate the airflow across the body 72 of the mattress 70.

Figure 7C:
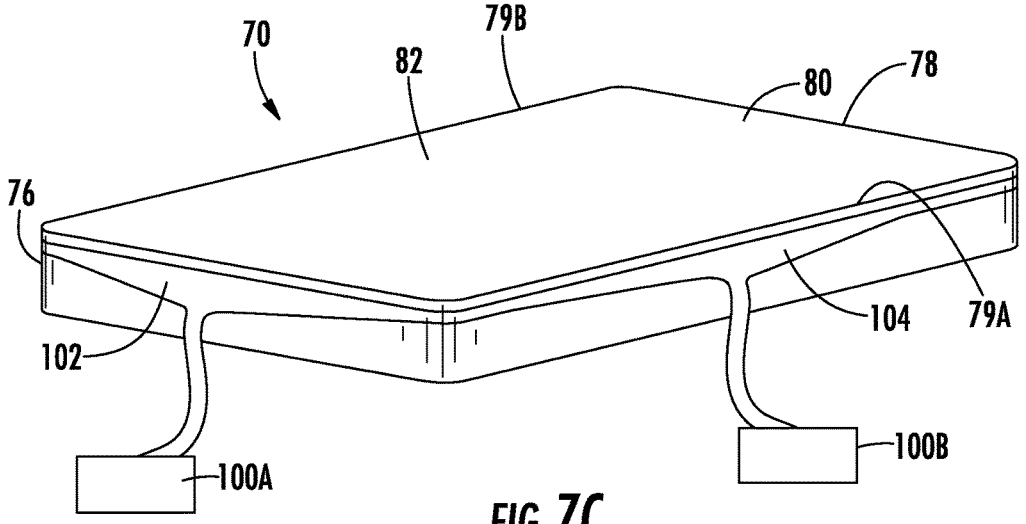
FIG. 7C illustrates a schematic perspective view of another embodiment of a mattress that comprises a cover material that can include an air flow feature according to the present subject matter.

In some embodiments, the airflow can be directed around the area most likely occupied by the user during use. In some embodiments, as shown in FIG. 7C, the two or more pumps 100A, 100B can be used for providing airflow from two or more different locations. For example, the pump 100A can provide air flow through a manifold that can extend across a bottom portion (or top portion) of the cover material 80 of the top panel 82 so that air flows from the base 76 of the matress 70 to the head 78 of the mattress 70, while the air pump 100B can provide air flow through a manifold 104 that can extend across a side portion of the cover material 80 of the top panel 82 so that air flows from one side 79A of the mattress 70 to the other side 79B of the mattress 78. In some embodiments, a single pump can provide airflow to two or more locations of the top cover material.

The cover material for a mattress that comprises a three-dimensional knit fabric disclosed herein can provide exceptional results based on the flammability standards test method outlined in the 1633 flammability standard. As discussed above, the test method is a full scale test based on the NIST research discussed above and in the NPR. The mattress specimen (a mattress alone or mattress and foundation set, usually in a twin size) is exposed to a pair of T-shaped propane burners and allowed to burn freely for a period of 30 minutes. The burners were designed to represent bedclothes. Measurements are taken of the heat release rate from the specimen and energy generated from the fire. The standard establishes two test criteria, both of which the mattress set must meet tn order to comply with she standard:

(1) The peak rate of heat release for the mattress set must not exceed 200 kW at any time during the 30 minute test; and (2) The total heat release must not exceed 15 MJ for the first 10 minutes of the test.

A mattress having a cover material that comprised a three-dimensional knit fabric was tested using the 1633 flammability standard test described above with positive results. The three-dimensional knit fabric comprised a first (or inner) layer comprising glass reinforced continuous multifilament micro denier yarns that form a fire resistant barrier when exposed to at least one of heat or flame and a second layer comprising polyester filament yarns. The three-dimensional knit fabric also comprised a middle layer between the first layer and the second layer with the middle layer comprising monofilament polyester yarns knitted to provide structural support and space between the first layer and the second layer.

Figure 8:
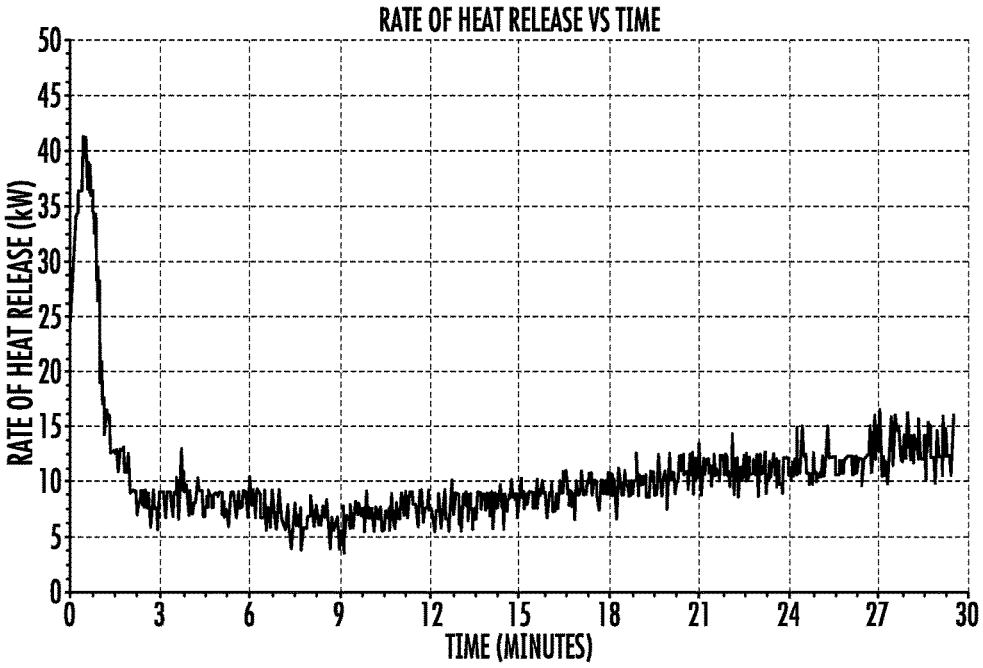
FIG. 8 illustrates a perspective view of an embodiment of a mattress sleeve that comprises a cover material according to the present subject matter.
Figure 8:
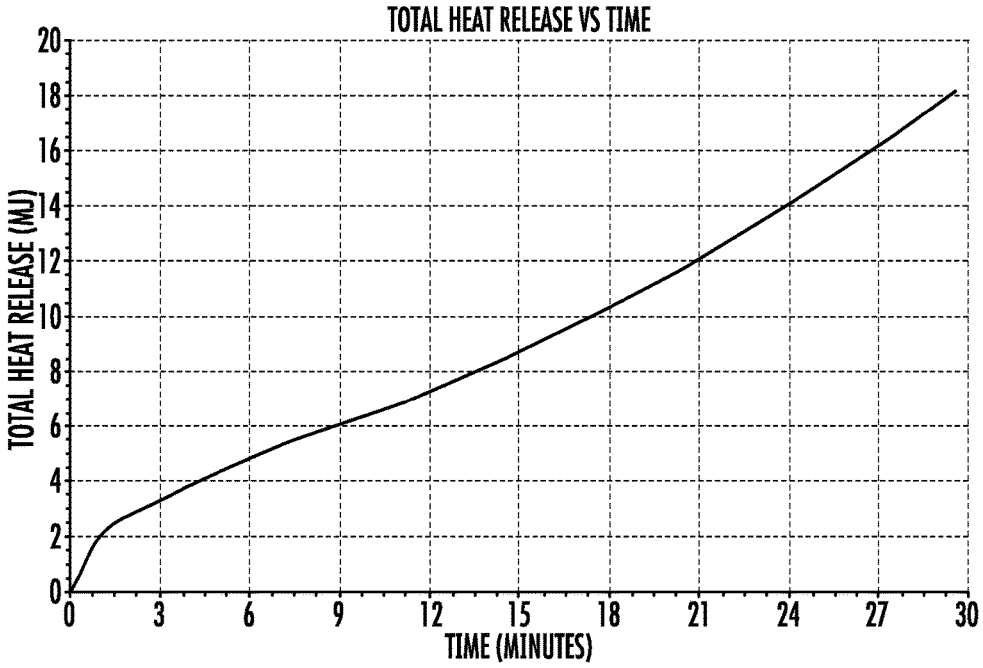

The results show that polyester yarns of the first and second layers melted and burned, while the layer at glass reinforced continuous multifilament micro denier yarns prevented the mattress core from igniting and limited the amount of heat that the fire set by the test generated. The measurement of the peak rate of heat release after 30 minutes of the embodiment tested was 41.2 kW, or about 20.6% of the maximum allowable peak rate of heat release for passage of the test. This result was astonishing low. Similarly, the measurement of the total heat release after 10 minutes of the embodiment tested was 6.2 MJ, or about 42.6% of the maximum allowable total heat release for passage of the test, which is also an astonishing low result. The results of the tests are shown in the graphs in FIG. 8. The top graph shows the measurement taken of the peak rate of heat release of the mattress over the 30 minutes of that portion of the test. As can be seen, the peak rate stayed low and fairly steady over the 30 minutes of the test with only a slight rise over time and not exceeding 41.2 kW as stated above. The bottom graph shows the measurement of the total heat release of the mattress over the 10 minutes of that portion of the test. As can be seen, the total heat release steadily rose in manner that is close to, or substantially, linear in nature over the 10 minutes of the test without seriously approaching the upper limits of the maximum total neat release of 15 MJ allowed over the first 10 minutes under the test. As seen in the bottom Graph of FIG. 8 the total heat release over 10 minutes approaches 6.2 MJ as stated above, while even after 20 minutes the total cumulative heat release was less than the maximum of 15 MJ required by the test after 10 minutes and less than 20 MJ after 30 minutes.

While not to be held to any theory. It is believed that different embodiment of the cover material disclosed herein based on types of yarns used for the different layers and the three-dimensional knit structures used can provide satisfactory test results for the peak rate of heat release and total heat release of the test method outlined in the 1633 flammability standard. For example, the measurement of the peak rate of heat release of some embodiments can be expected to fee less than 200 kW over 30 minutes. In some embodiments, the measurement of the peak rate of heat release of some embodiments can be expected to be about 130 kW or less over 30 minutes. In some embodiments, the peak rate of heat release can be expected to be about 100 KW or less over 30 minutes. In some embodiments, the peak rate of heat release can be expected to be about 70 kW or less over 30 minutes. In some embodiments, the peak rate of heat release can be expected to be about 50 kW or less over 30 minutes. In some embodiments, the peak rate of heat release can be expected to be about 45 kW or less over 30 minutes. In some embodiments, the peak rate of heat release can be expected to be about 40 kW or less over 30 minutes.

Similarly, the total heat release of the test outlined in the 1633 flammability standard in some embodiments can be expected to be less 15 MJ over 10 minutes. In some embodiments, the total heat release of the test outlined in the 1633 flammability standard in some embodiments can be expected to be about 14 MJ or less over 10 minutes. In some embodiments, the total heat release can be expected to be about 12 MJ or less over 10 minutes. In some embodiments the total heat release can be expected to be about 10 MJ or less over 10 minutes. In some embodiments the total heat release can be expected to be about 8 MJ or less over 10 minutes. In some embodiments, the total heat release can be expected to be about 3 MJ or less over 10 minutes.

Thus, as disclosed herein, various embodiments of mattresses and different embodiments of cover materials for use on mattresses are provided. For example, cover material for use on a mattress can be provided that comprises a three-dimensional knit fabric. In some embodiments, the cover material can be lightweight and portable and can be placed on and removed on different mattresses. In some embodiments, the cover material can be permanently attached to a mattress. For example, the cover material can comprise, or serve, as the ticking on the mattress. In some embodiments, the cover material satisfies the standard for flammability (open flame) of mattress and mattresses sets disclosed in 16 C.F.R. Part 1633 entitled Standard for the Flammability (Open Flame) of Mattress Sets (hereinafter the "1633 flammability standard"). The three-dimensional knit fabric can comprise a first layer comprising glass reinforced continuous multifilament micro denier yarns that form a fire resistant barrier when exposed to at least one of heat or flame and a second layer comprising polymer filament yarns with middle layer provided between the first layer and the second layer. The middle layer can comprise monofilament polymer yarns knitted to provide structural support and space between the first layer and the second layer.

In some such embodiments of a cover material, the continuous multifilament micro denier yarn of the first layer can comprise a polyester fiber filament core and modacrylic copolymer fiber filament inner sheath and a fire resistant rayon filament wrap outer sheath. In some embodiments, the polyester fiber filament of the continuous multifilament micro denier yarn can provide a tensile strength that can increase tear strength of the cover material. In some embodiments, the first layer can comprise a closed knit construction to provide a fire resistant barrier that at least one limits or precludes exposure of combustible material Integrated into a mattress core.

In some embodiments, the polymer filament yarns of the second layer can comprise at least one of a polyester filament yarn or a polypropylene yarn. In other embodiments, the polymer filament yarns of the second layer can comprise at least one of a nylon yarn, a polyethylene yarn, or an aramid yarn. In some embodiments, the polymer filament yarns of the second layer can comprise some combination of polyester filament yarn, a polypropylene yarn, a nylon yarn, a polyethylene yarn, and/or an aramid yarn. In some embodiments, the second layer can include a customer specific knitting pattern. For example, the second layer can include a company logo or other design knitted therein. In some embodiments, the second layer can comprise a standard mesh knitting pattern that provides at least one of kicking or airflow features.

In some embodiments, the second layer can be treated with a chemical finish. For instance, the chemical finish can comprise at least one of an infra-red reflective finish, an antimicrobial finish, an anti-mildew finish, an anti-bacterial finish, a flame retardant finish, a fire resistant finish, or a water repellent dependent upon the specific bedding mattress application.

The monofilament polymer yarns of the middle layer can comprise at least one of a polyester yarn, a polypropylene yarn, a nylon yarn, a polyethylene yarn, or an aramid yarn. In some embodiments, the monofilament polymer yarns of the middle layer can comprise a weight per unit length of between about 20 denier and about 400 denier. For example, the monofilament polymer yarns of the middle layer can comprise a weight per unit length of between about 70 denier and about 120 denier. In some embodiments, the denier of the monofilament polymer yarns of the middle layer can depend upon at least one of the desired support features of the cover material or the desired airflow features of the cover material.

In some embodiments, the monofilament polymer yarns of the middle layer can form one or more channels within the structure to provide the airflow, compression and load spreading features. In some embodiments the monofilament polymer yarns of the middle layer can form a separation distance between the first layer and a second layer to form channels therebetween. In some such embodiments, the separation distance can be between about 2 mm and 10 mm. For example, the separation distance can be chosen based on the at least one of the support features of the cover material or the airflow features of the cover material.

The three dimensional fabric can provide different aspects to the mattress on which the cover material is used that can be benefit to the user who sleeps on such a covered mattress. In some embodiments of the cover material, the three dimensional knit fabric of the cover material can be a breathable fabric. For example, in some embodiments, the second layer of the three dimensional knit fabric of the cover material is breathable. In some embodiments, the second layer and the middle layer of the three dimensional knit fabric of the cover material can be breathable. Additionally, in some embodiments, the three dimensional knit fabric of the cover material can comprise a structure that provides moisture winking capabilities for health and medical comfort aspects that also meets the 1633 flammability standard. In some embodiments, the three dimensional knit fabric of the cover material provides compassion and load spreading equalization. Further, the three dimensional knit fabric of the cover material provides compressibility coupled with support and contouring as an aid to treatment of pressure points and bed sores. As an added benefit, the cover material can be washable in a washing machine. To this end and as another added benefit, the cover material can comprise material and/or have a construction that can make the cover material quick drying.

The three dimensional knit fabric of the cover material can comprise a wide range of thicknesses and contours. As described with reference to the second layer above, the three dimensional knit fabric can comprise a structure that displays an image such as a logo or wording in some embodiments. In some embodiments, the three dimensional knit fabric of the cover material can comprise at least one of an infra-red reflective, antimicrobial, anti-mildew, anti-bacterial, a fire resistant, or moisture repellant coating. In some embodiments, the three dimensional knit fabric can comprise an air circulation substrate for specific body and medical application requirements.

As stated above, in some embodiments, the cover material can comprise a closable sleeve that is securable around a mattress. In some embodiments, the closable sleeve can be sized to fit specifically sized mattresses. Thus, a cover material used to provide an outer surface of a mattress can be provided that can comprise a three-dimensional knit fabric that can form a first layer comprising fire resistant corespun yarns and a second layer comprising polymer filament yarns with a middle layer between the first layer and the second layer. The middle layer can comprise monofilament polymer yarns knitted to provide structural support and space between the first layer and the second layer.

Additionally, in some embodiments, the cover material can comprise an outer ticking fabric of a mattress. Thus, in some embodiments, a mattress can be provided that can comprise a body having a size and shape to support a user while resting as well as a cover material secured around the body to form an outer surface of the mattress. The cover material can comprise a three-dimensional knit fabric. The three-dimensional fabric can comprise a first layer comprising glass reinforced continuous multifilament micro denier yarns that form a fire resistant barrier when exposed to at least one of heal or flame and a second layer comprising polymer filament yarns with a middle layer between the first layer and the second layer. The middle layer can comprise monofilament polymer yarns knitted to provide structural support and space between the first layer and the second layer.

In some embodiments, the body of the mattress can comprise a foam material. In some embodiments, the body of the mattress can comprise box springs and a foam material. In some embodiments, the body of the mattress can comprise batting, cushioning nonwoven material, barrier materials and/or some other type of mattress stuffing.

Different embodiments of cover material can provide different features to the mattress on which it is used. In some embodiments of the mattress, the cover material can satisfy the standard for flammability (open flame) for mattresses and mattress sets disclosed in the 1633 flammability standard. For example, the three dimensional knit fabric of the cover material can comprise a structure that can provide moisture wicking capabilities for health and medical comfort aspects that also meets the 1633 flammability standard. Additionally, in some embodiments of the mattress, the three dimensional knit fabric of the cover material can be a breathable fabric. For example, in some embodiments, the second layer of the three dimensional knit fabric of the cover material can be breathable. In some embodiments, the second layer and the middle layer of the three dimensional knit fabric of the cover material can be breathable. In some embodiments of the mattress, the three dimensional knit fabric of the cover material can provide compression and load spreading equalization. Further, in some embodiments of the mattress, the three dimensional knit fabric of the cover material can provide compressibility coupled with support and contouring as an aid to treatment of pressure points and bed sores. As an added benefit, the cover material can comprise material and/or have a construction that can make the cover material quick drying. In some embodiments of the mattress, the cover material can comprise a sleeve that is removable from the mattress. In some embodiments, such a removable cover material can be machine washable.

The three dimensional fabric of the cover material of the mattress can comprise other features as well in addition to the ones described above. For example, the three dimensional knit fabric of the cover material can comprise a wide range of thicknesses and contours. In some embodiments of the mattress, the three dimensional knit fabric of the cover material can comprise a stretchability and recovery without compromising the fire resistance barrier forming ability of the three dimensional knit fabric. As described, the three dimensional knit fabric can comprise a structure that displays an image such as a logo or wording in some embodiments. In some embodiments of the mattress, the three dimensional knit fabric can comprise at least one of an infra-red effective, antimicrobial, anti-mildew, anti-bacterial, a fire resistant, or moisture repellent coating. In some embodiments, the three dimensional knit fabric can comprise an air circulation substrate for specific body and medical application requirements.

In some embodiments of the mattress the continuous multifilament micro denier yarn of the first layer of the cover material can comprise a polyester fiber filament core and modacrylic copolymer fiber filament inner sheath and a fire resistant rayon filament wrap outer sheath. In some embodiments, the polyester fiber filament of the continuous multifilament micro denier yarn can provide tensile strength. In some embodiments of the mattress, the first layer of the three-dimensional knit fabric can comprise a closed knit construction to provide a fire resistant barrier that can either limit or preclude exposure of combustible material Integrated into a mattress core.

In some embodiments of the mattress, the polymer filament yarns of the second layer of the three-dimensional knit fabric of the cover material can comprise at least one of a polyester filament yarn or a polypropylene yarn and in some embodiments can comprise at least one of a nylon yarn, a polyethylene yarn, or an aramid yarn. In some embodiments, the second layer of the three-dimensional knit fabric can include a customer specific knitting pattern. For example, the second layer can include a company logo or other design knitted therein. In some embodiments, the second layer of the three-dimensional knit fabric of the cover material can comprise a standard mesh knitting pattern that provides at least one of wicking or airflow features.

In some embodiments of the mattress, the second layer of the three-dimensional knit fabric of the cover material can be treated with a chemical finish. For example, the chemical finish can comprise at least one of an infra-red reflective finish, an antimicrobial finish, an anti-mildew finish, an anti-bacterial finish, a flame retardant finish, a fire resistant finish, or a wafer repellent dependent upon the specific bedding mattress application.

In some embodiments of the mattress, the monofilament polymer yarns of the middle layer of the cover material can comprise at least one of a polyester yarn, a polypropylene yarn, a nylon yarn, a polyethylene yarn, or an aramid yarn. In some embodiments, the monofilament polymer yarns of the middle layer of the cover material can comprise a weight per unit length of between about 20 denier and about 400 denier. For example, the monofilament polymer yarns of the middle layer can comprise a weight per unit length of between about 70 denier and about 120 denier. In some embodiments the denier of the monofilament polymer yarns of the middle layer depends upon at least one of the support features of the cover material or the airflow features of the cover material.

In some embodiments of the mattress, the monofilament polymer yarns of the middle layer of the cover material can form one or more channels within the structure to provide the airflow, compression and load spreading features. In some embodiments, the monofilament polymer yarns of the middle layer can form a separation distance between the first layer and a second layer to form channels therebetween. For example, in some such embodiments, the separation distance is between about 2 mm and 10 mm. In such embodiments, criteria for the setting the separation distance can be used. For example, the separation distance can be chosen based on the at least one of the support features of the cover material that are desired or the and/or features of the cover material that are desired.

Thus, as example, a fire resistant mattress can be provided that can comprise a body having a size and shape to support a user while resting and a cover material secured around the body to form an outer surface of the mattress. The cover material can comprise a three-dimensional knit fabric that forms a first layer comprising fire resistant corespun yarns and a second layer comprising polymer filament yarns with a middle layer between the first layer and the second layer. The middle layer can comprise monofilament polymers yarns knitted to provide structural support and space between the first layer and the second layer.

Many features and aspects of a mattress can be provided, modified and/or enhanced with the different constructions of the cover material described herein. For example, in some embodiments, the cover material can produce a peak rate of heat release based on the test methods outlined in the 1633 flammability standard of less than 200 kW over 30 minutes. For example, in some embodiments, the cover material can produce a peak rate of heat release based on the test methods outlined in the 1633 flammability standard of about 150 kW or less over 30 minutes. For instance, in some embodiments, the cover material can produce a peak rate of heat release based on the test methods outlined in the 1633 flammability standard of about 100 kW or less over 30 minutes.

Even great fire resistance can be provided in some embodiments. For example, the cover material used on some mattresses can produce a peak rate of heat release based on the test methods outlined in the 1633 flammability standard of about 70 kW or less over 30 minutes. Additionally, in some embodiments, the cover material can produce a peak rate of heat release based on the test methods outlined in the 1633 flammability standard of about 50 KW or less over 30 minutes. For example, in some embodiments, the cover material can produce a peak rate of heat release based on the test methods outlined in the 1633 flammability standard of about 45 kW or less over 30 minutes. More particularly, in some embodiments, the cover material can produce a peak rate of heat release based on the test methods outlined in the 1833 flammability standard of about 41.2 kW over 30 minutes.

As another way to measure the fire resistant benefits of the different embodiments of the cover material disclosed herein, in some embodiments, the cover material can produce a total heat release based on the test methods outlined in the 1633 flammability standard of less 15 MJ over 10 minutes. In some embodiments, the cover material can produce a total heat release based on the test methods outlined in the 1633 flammability standard of about 14 MJ or less over 10 minutes. Additionally, in some embodiments, the cover material can produce a total heat release based on the test methods outlined in the 1633 flammability standard of about 12 MJ or less over 10 minutes. For example, in some embodiments, the cover material can produce a total heat release based on the test methods outlined in the 1633 flammability standard of about 10 MJ or less over 10 minutes. As another example, in some embodiments, the cover material can produce a total heat release based on the test methods outlined in the 1633 flammability standard of about 8 MJ or less over 10 minutes. More particularly, in some embodiments, the cover material can produce a total heat release based on the test methods outlined in the 1633 flammability standard of about 6.2 MJ over 10 minutes.

Methods of making a fire resistant mattress are also provided herein. For example, in some embodiments, a method can be provided in which a mattress body having a size and shape to support a user while resting is provided and a cover material to form an outer surface of the mattress is also provided. The cover material can comprise a three-dimensional knit fabric that can form a first layer comprising fire resistant corespun yarns and a second layer comprising polymer filament yarns with a middle layer between the first layer and the second layer. The middle layer can comprise monofilament polymer yarns knitted to provide structural support and space between the first layer and the second layer. The cover material can then be secured around the mattress body. For example, in some embodiments, the cover material can be pre-constructed into a closeable sleeve that fits the dimensions of the mattress body. The sleeve can them be placed around the mattress body and closed. Such a sleeve can be removable so that it may be washed. For example, the sleeve may be machine washable. In some embodiments of the method, the step of providing the body can comprise constructing the body using a foam material. In some embodiments of the method, the step of providing the body can comprise constructing the body using a foam material and box springs. In some embodiments of the method, the step of providing a cover material can comprise knitting the three-dimensional knit fabric with yarns as described above.

These and other modifications and variations to the present subject matter may be practiced by those of ordinary skill in the art, without departing from the spirit and scope of the present subject matter, which is more particularly set forth herein above. In addition, if should be understood the aspects of the various embodiments may be interchanged both in whole or in part. Furthermore, those of ordinary skill in the art will appreciate that the foregoing description is by way of example only, and is not intended to limit the present subject matter. Reference signs incorporated in the claims solely to ease their understanding, and do not limit the scope of the claims.

What is claimed is:

1. A fire resistant mattress comprising:

a body having a size and shape to support a user while resting;

a cover material secured around the body to form an outer surface of the mattress, the cover material comprising:

a three-dimensional knit fabric comprising a first layer, a second layer, and a middle layer between the first layer and the second layer;

the first layer comprising fire resistant corespun yarns, wherein in the first layer is configured to be the lowermost layer proximate to the body of the mattress;

the second layer comprising polymer filament yarns, wherein the second layer is configured to be the uppermost layer to be proximate to the user; and the middle layer comprising monofilament polymer yarns knitted to provide structural support and space between the first layer and the second layer.

2. The mattress according to claim 1, wherein the first layer of the three-dimensional knit fabric comprises glass reinforced continuous multifilament micro denier yarns that form a fire resistant barrier when exposed to at least one of heat or flame and wherein the continuous multifilament micro denier yarn comprises a polyester fiber filament core and modacrylic copolymer fiber filament inner sheath and a fire resistant rayon filament wrap outer sheath.

3. The mattress according to claim 1, wherein the first layer of the three-dimensional knit fabric comprises a closed knit construction to provide a fire resistant barrier that limits exposure of combustible material integrated into the body.

4. The mattress according to claim 1, wherein the second layer of the three-dimensional knit fabric comprises a standard mesh knit construction that provides at least one of a wicking feature that wicks moisture away from a body of a person lying on the mattress or an airflow feature that permit air to flow between the first layer and second layer of the three-dimensional knit fabric and through the second layer.

5. The mattress according to claim 1, wherein the monofilament polymer yarns of the middle layer of the three-dimensional knit fabric comprises a weight per unit length of between about 20 denier and about 400 denier.

6. The mattress according to claim 1, wherein the denier of the monofilament polymer yarns of the middle layer of the three-dimensional knit fabric is configured to provide compressive support to a body of a person lying on the mattress.

7. The mattress according to claim 1, wherein the denier of the monofilament polymer yarns of the middle layer of the three-dimensional knit fabric is configured to permit air to flow between the first layer and second layer of the three-dimensional knit fabric.

8. The mattress according to claim 1, wherein the monofilament polymer yarns of the middle layer of the three-dimensional knit fabric forms one or more channels within the three-dimensional knit fabric to provide airflow between the first layer and the second layer and to facilitate the distribution the load of a body of a person lying on the mattress.

9. The mattress according to claim 1, wherein the monofilament polymer yarns of the middle layer of the three-dimensional knit fabric form a separation distance between the first layer and the second layer of the three-dimensional knit fabric to form channels therebetween.

10. The mattress according to claim 1, wherein the three dimensional knit fabric comprises at least one of an infra-red reflective, antimicrobial, anti-mildew, anti-bacterial, a fire resistant, or moisture repellant coating.

11. The mattress according to claim 1, wherein the three dimensional knit fabric comprises an air circulation substrate.

12. The mattress according to claim 1, wherein the cover material produces a peak rate of heat release based on the test methods outlined in the 1633 flammability standard of less than 200 kW over 30 minutes.

13. The mattress according to claim 1, wherein the cover material produces a peak rate of heat release based on the test methods outlined in the 1633 flammability standard of about 50 kW or less over 30 minutes.

14. The mattress according to claim 1, wherein the cover material produces a total heat release based on the test methods outlined in the 1633 flammability standard of less 15 MJ over 10 minutes.

15. The mattress according to claim 1, wherein the cover material produces a total heat release based on the test methods outlined in the 1633 flammability standard of about 8 MJ or less over 10 minutes.

* * * * *